US006729484B2

(12) United States Patent
Sparkowski

(10) Patent No.: US 6,729,484 B2
(45) Date of Patent: May 4, 2004

(54) MULTI-POSITION DISPLAY RACK

(75) Inventor: Robert P. Sparkowski, Schaumburg, IL (US)

(73) Assignee: Chicago Display Marketing Corporation, Melrose Park, IL (US)

( * ) Notice: Subject to any disclaimer, the term of this patent is extended or adjusted under 35 U.S.C. 154(b) by 0 days.

(21) Appl. No.: 10/225,031

(22) Filed: Aug. 21, 2002

(65) Prior Publication Data

US 2004/0035813 A1 Feb. 26, 2004

(51) Int. Cl.[7] ..... A47B 47/00
(52) U.S. Cl. ..... 211/187; 211/134
(58) Field of Search ..... 211/187, 45, 59.2, 211/186, 150, 189, 192, 134

(56) References Cited

U.S. PATENT DOCUMENTS 2,648,442 A 8/1953 Lowmaster
3,915,097 A * 10/1975 Young, Jr. ..... 108/6
4,231,301 A * 11/1980 Barrineau, III ..... 108/146
4,292,902 A 10/1981 Barrineau
5,160,051 A * 11/1992 Bustos ..... 211/59.2
5,383,562 A * 1/1995 Gay ..... 211/181.1
5,450,971 A 9/1995 Boron et al.
5,645,182 A 7/1997 Miller, Jr. et al.
5,718,441 A * 2/1998 Kern et al. ..... 280/79.3
5,797,502 A * 8/1998 Brady et al. ..... 211/183
6,095,347 A * 8/2000 Mauro-Vetter ..... 211/151
6,116,436 A * 9/2000 Ferrucci et al. ..... 211/187
6,332,547 B1 * 12/2001 Shaw et al. ..... 211/59.2
6,607,083 B1 * 8/2003 Webb ..... 211/59.2

* cited by examiner

*Primary Examiner*—Daniel P. Stodola
*Assistant Examiner*—Sarah Purol
(74) *Attorney, Agent, or Firm*—Vedder Price Kaufman & Kammholz

(57) ABSTRACT

A multi-position display rack includes first and second sides having parallel mounting faces and front and rear columns of spaced apertures aligned in opposition to define front and rear sets of apertures. A removable shelf is adapted to be supported between the first and second sides and includes a frame having front and rear hooks. The front hooks are connected to the frame for rotative and sliding movement within an adjustment zone. Support elements extend through the adjustment zone and contact the front hooks to transfer loads from the shelf to the first and second sides. The rear hooks lock the shelf to a set of rear apertures and the front hooks may engage a plurality of selected sets of front apertures.

29 Claims, 6 Drawing Sheets

MULTI-POSITION DISPLAY RACK

BACKGROUND OF THE INVENTION

This invention relates to racks for supporting items in a highly visible and readily accessible position for display and sale to the public. In particular, the present invention relates to such a display rack including at least one removable shelf having front hooks which are rotatively and slidably moveable within an adjustment zone such that the front hooks may engage a plurality of selected sets of front apertures in order to dispose the shelf in various different inclined positions.

A wide variety of display devices have been designed and manufactured for use in merchandising shelved products to consumers. A major disadvantage of prior art shelving designs is a lack easily adjustable shelves. When adjustable shelves are provided, the range of adjustment is limited, the act of adjusting of the shelves is complicated and the shelves are not stable.

U.S. Pat. No. 5,450,971, issued to Boron, et al., describes an adjustable shelf support structure for use in product merchandising display equipment which includes members that telescopingly engage each other such that the members can be moved relative to one another to change the overall width of the support shelf. These members further include a mechanism for varying the effective length of opposing sides of the shelf. A plurality of hooks are provided and one is disposed at each corner of the shelf. The hooks are rotationally and slidingly moveable with respect to the members such that the hooks may engage existing display equipment so as to orient the shelf in either a substantially flat horizontal position or an inclined position for gravity feed operations. The hooks are freely moveable with respect to the members such that the shelf hangs from the hooks. Connecting the shelf to the support is difficult because each hook is independently moveable with respect to the other. Thus, control of the shelf during installation is compromised. Further, there is no structure in connection with the shelf which locks the shelf in place to prevent disengagement of the hooks as a result of unintentional jostling. Accordingly, the shelf of this invention is not stable and product may be damaged as a result.

Further disadvantages of prior art display racks include an apparatus where clips are attached to the upright supports so that the shelf may be disposed thereupon. In this manner, the shelf may be positioned at various different heights and inclinations. However, this design is not easily adjustable as a user must manually support or remove the shelf in order to reposition the support clips into the newly desired position.

Therefore, there is a need for a multi-position display rack having adjustable shelves which are exceptionally simple and economical, sturdy, and lockable into the desired position.

BRIEF DESCRIPTION OF THE DRAWINGS

The invention may be best understood by reference to the following description taken in conjunction with the accompanying drawings, in the several figures of which like reference numerals identify like elements.

DETAILED DESCRIPTION OF A PREFERRED EMBODIMENT OF THE INVENTION

The multi-position display rack of the present invention is primarily for use in stores in order to display goods for sale. The multi-position display rack includes a first side including a first mounting face having front and rear columns of spaced apertures formed therein. A second side includes a second mounting face having front and rear columns of spaced apertures therein. The first and second sides are disposed parallel such that each front column aperture in the first side is aligned in opposition with a corresponding front column aperture in the second side to define a set of front apertures and each rear column aperture in the first side is aligned in opposition with a corresponding rear column aperture in the second side to define a set of rear apertures.

At least one removable shelf is supportable between the first and second sides. The shelf includes a frame including front hooks and rear hooks. The front hooks each engage one of the selected set of front apertures and are each connected to the frame for rotative and sliding movement within an adjustment zone defined by spaced first and second cross members. Support elements extend through the adjustment zone for contacting the front hooks when the hooks are rotated to engage the set of front apertures such that loads are transferred from the shelf to the first and second sides. The rear hooks extend from a third cross member for engaging a set of rear apertures and include a means for locking the shelf to the set of the rear apertures. The front hooks may engage a plurality of selected sets of front apertures for each selected set of rear apertures engaged by the rear hooks.

Figure 1:
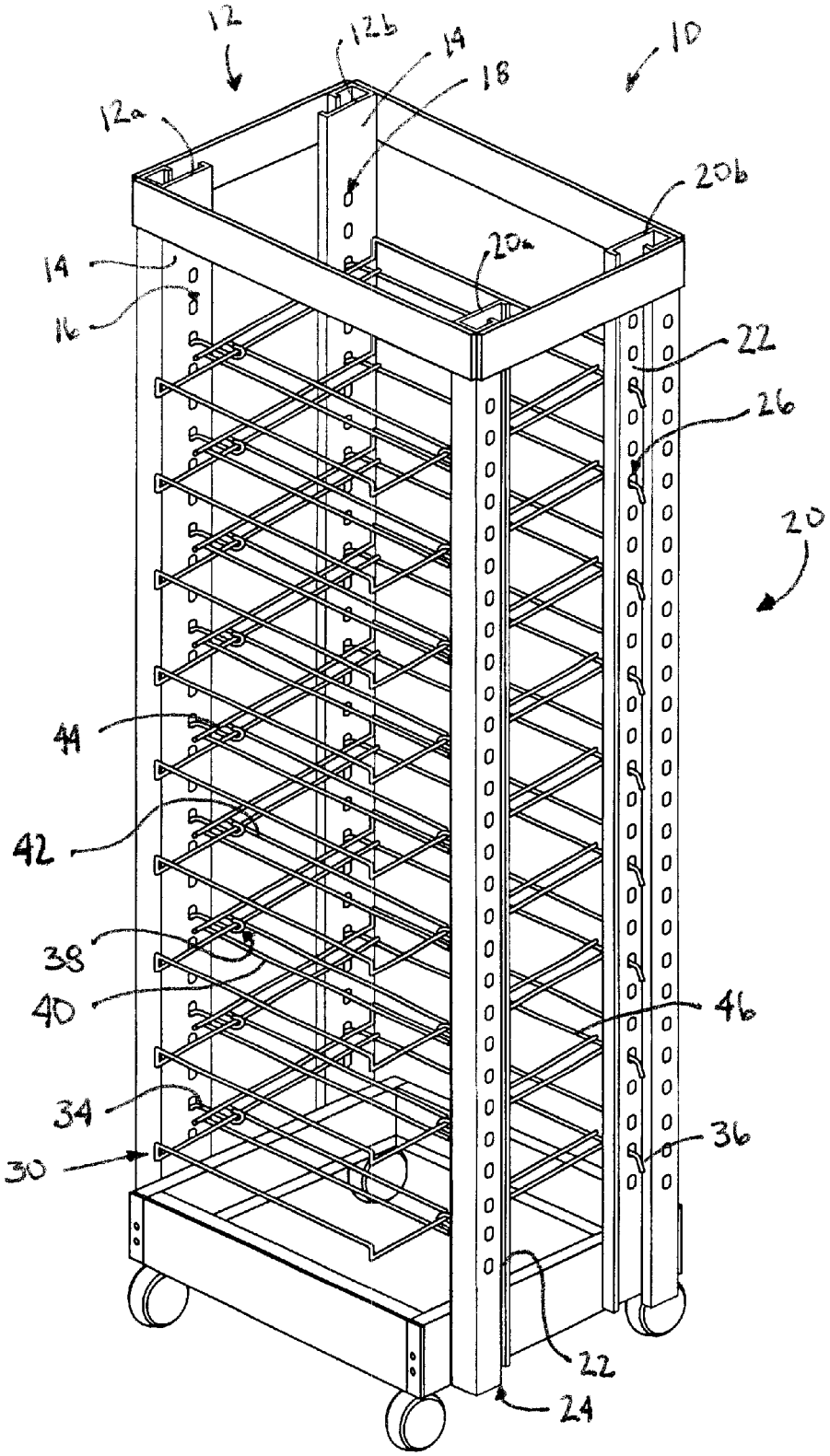
FIG. 1 is a perspective view of a multi-position display rack in accordance with one embodiment of the present invention.

FIG. 1 is a perspective view of a multi-position display rack 10 of one embodiment of the present invention. The display rack 10 includes a first side 12 including a first mounting face 14 having front and rear columns of spaced apertures 16, 18 formed therein. A second side 20 includes a second mounting face 22 having front and rear columns of spaced apertures 24, 26 formed therein. The first and second sides 12, 20 are disposed parallel such that each front column aperture 16 in the first side 12 is aligned and in opposition with a corresponding front column aperture 24 in the second side 20 to define a set of front apertures and each rear column aperture 18 in the first side 12 is aligned in opposition with a corresponding rear column aperture 26 in the second side 20 to define a set of rear apertures.

At least one removable shelf 30 is supportable between the first and second sides 12, 20. The shelf 30 includes a frame 32 having front hooks 34 and rear hooks 36. As shown in this embodiment, the frame 32 and hooks 34, 36 of the present invention may be formed from a metal wire, plastic or other suitable material. The front hooks 34 are each connected to the frame 32 for rotative and sliding movement (see FIGS. 7 and 9) within an adjustment zone 38 defined between spaced first 40 and second 42 cross members. The front hooks 34 engage a selected set of front apertures in order to support the shelf 30.

Support elements 44 extend through the adjustment zone 38 for contacting the front hooks 34 when the front hooks 34 are rotated to engage the set of front apertures such that loads are transferred from the shelf 30 to the first and second sides 12, 20. The rear hooks 36 extend from a third cross member 46 to engage a selected set of rear apertures and include a means for locking the shelf to the set of rear apertures as discussed below with regard to FIGS. 7–9. The front hooks 34 may engage a plurality of selected sets of front apertures (as shown in FIG. 6) for each of the selected set of rear apertures engaged by rear hooks.

Figure 6:
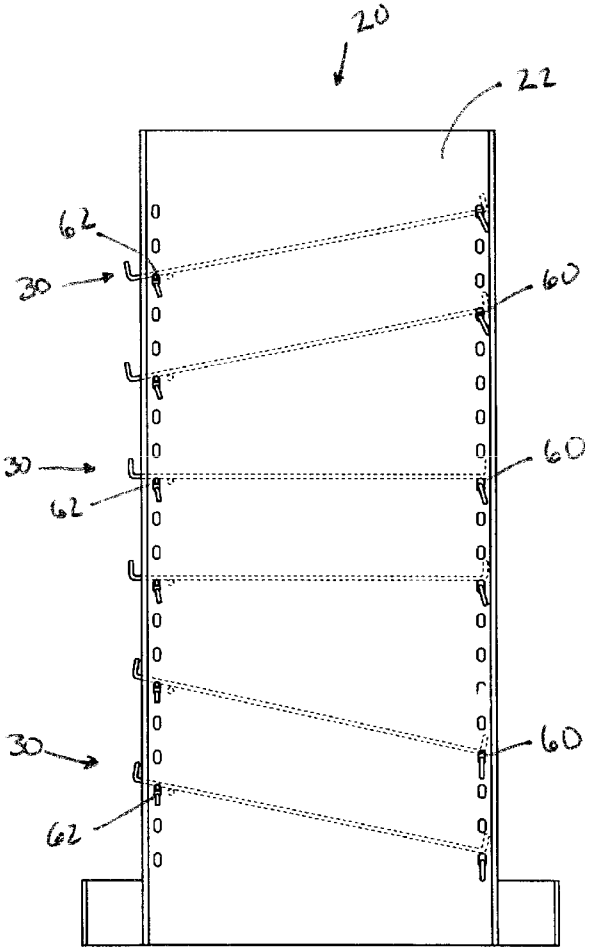
FIG. 6 is a side elevation view of a multi-position display rack in accordance with another embodiment of the present invention as shown in FIG. 5.
Figure 5:
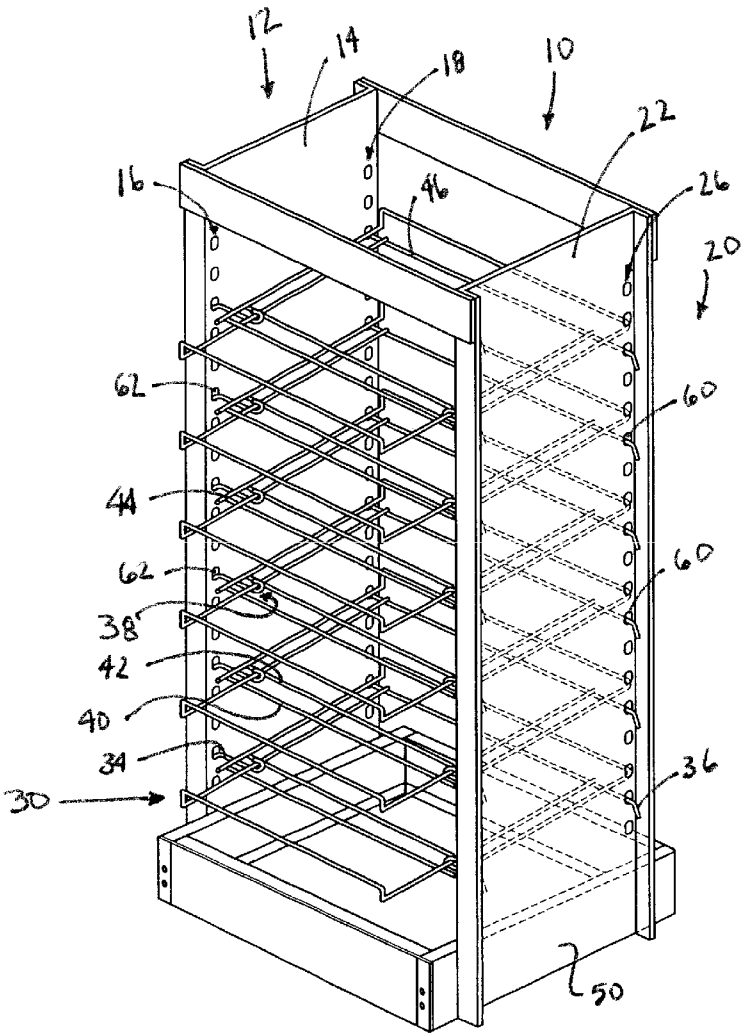
FIG. 5 is a perspective view of a multi-position display rack in accordance with another embodiment of the present invention.

As shown in this embodiment, the first and second sides 12, 20 may be defined by a pair of spaced upright elements 12*a*, 12*b*, 20*a*, 20*b*, as shown in FIGS. 1, 2, 10 and 11, or by separate sheet-formed elements, as shown in FIGS. 5 and 6. The upright elements 12*a*, 12*b*, 20*a*, 20*b* illustrated in this embodiment are generally formed as number 6 or G-shaped pieces when oriented properly, and are made of any appropriate material such as iron, aluminum or any other suitable material. The first and second mounting faces 14, 22 are defined by the longer side portion of each upright element 12*a*, 12*b*, 20*a*, 20*b* which extends toward the other upright element 12*a*, 12*b*, 20*a*, 20*b* disposed on the same side. It is within the teachings of the present invention that other side configurations could be utilized for supporting removable shelves.

Each column of apertures 16, 18, 24, 26 includes a plurality of vertically spaced apertures formed in the first or second mounting faces 14, 22. It is within the teachings of the present invention that each of the apertures may be formed as vertically elongated slots or other openings utilized for engaging the hooks 34, 36. Vertically elongated slots are preferred for the ease with which the shelves may be connected and removed.

Figure 2:
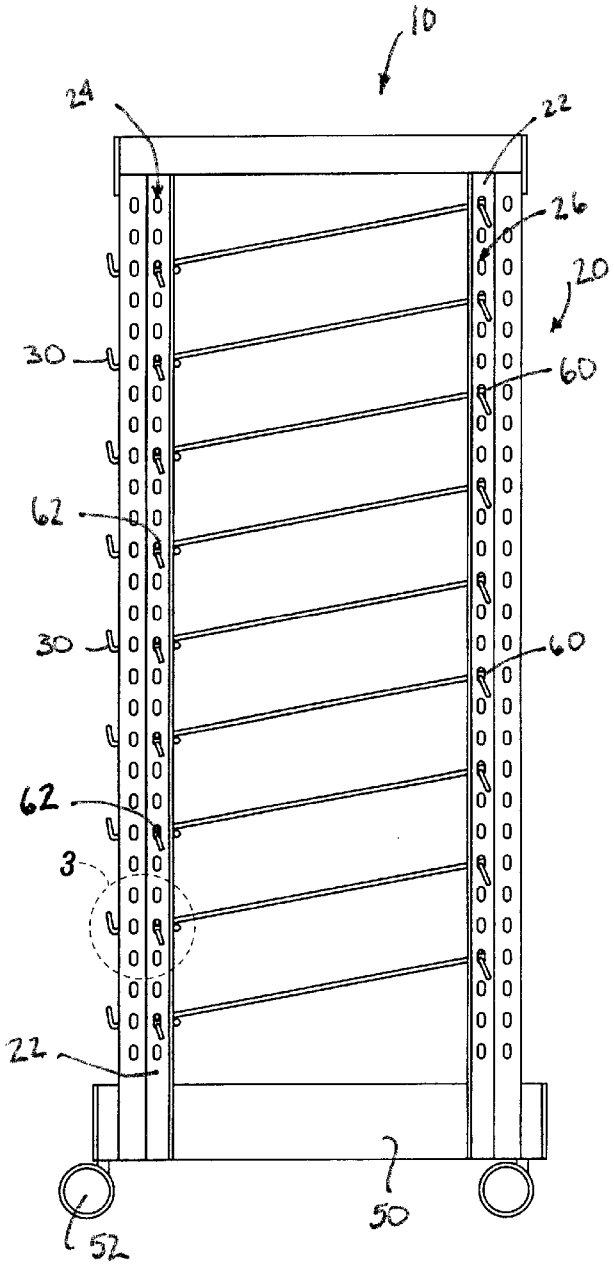
FIG. 2 is a side elevation view of a multi-position display rack in accordance with one embodiment of the present invention.

FIG. 2 is a side elevation view of the multi-position display rack 10 of one embodiment of the present invention. The second side 20 is illustrates the second mounting face 22, defined between the space uprights as described above, having front and rear columns of spaced apertures 24, 26 formed therein. A lower support 50 may include casters 52 in order to provide mobility for the multi-position display rack 10. A plurality of removable shelves 30 are supported between the first (not shown) and second 20 sides in an inclined orientation such that the selected set of rear apertures 60 is disposed at a level above the selected set of front apertures 62.

Figure 3:
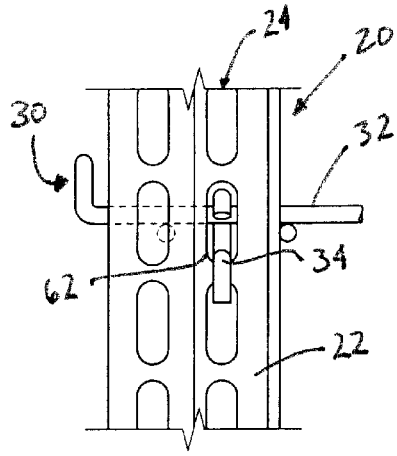
FIG. 3 is a detail view of a shelf hook engaging a multi-position display rack in accordance with one embodiment of the present invention, as shown in FIG. 2.

FIG. 3 is a highlighted detail view of a portion of FIG. 2 of one embodiment of the present invention. As shown in this embodiment, the front hook 34 is crimped to the frame 32. Other suitable methods of connecting the hook 34 to the frame may be utilized. The hook 34 connects the shelf 30 to the front upright of the second side 20 in this FIG. 3. The second mounting face 22 has a column of spaced apertures 24 formed therein for engaging the hook 34. The hooks 34 extend away from the sides of the shelf 30 as viewed from the front of the display rack 10 where the first side 12 is disposed on a viewer's left and the second side 20 is disposed on the viewer's right. Such configuration disposes the mounting face 22 immediately adjacent the shelf 30 so that the front hook 34 may easily manipulated to engage one of the selected set of front apertures 62. This overcomes a disadvantage of the prior art where the apertures were formed in the front and rear faces of the first and second sides, i.e. those portions of the uprights which define a plane across the front and back of the rack extending between the first and second sides.

A column of spaced apertures is formed in the auxiliary face 15, 23 of each upright 12*a*, 12*b*, 20*a* and 20*b* (see FIGS. 1 and 2) and shown with specificity in FIG. 3. Each auxiliary face 15, 23 is returned to each mounting face 14, 22 and define the outer perimeter of the display rack 10. The auxiliary face 15, 23 column of apertures are useful for hanging promotional items or other products related to those in the shelves in order to generate additional revenue.

Figure 4:
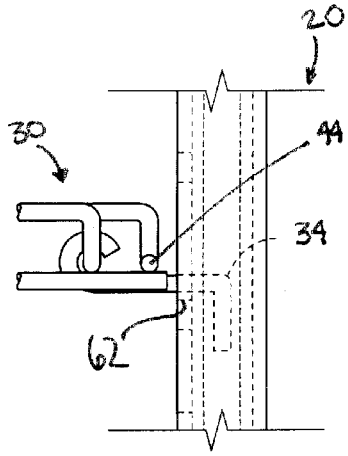
FIG. 4 is a detailed front elevation view of the highlighted detail view of FIG. 3 in accordance with one embodiment of the present invention.

FIG. 4 is a front view of the detailed highlighted portion of FIG. 3 of one embodiment of the present invention. The shelf 30, when the front hook 34 engages the second side 20 apertures, may be lowered until a support element 44 contacts the hook 34. In this embodiment, loads are transferred from the shelf 30 to the second side 20 and the shelf 30 remains stable regardless of weight distribution on the shelf 30. One advantage of the present invention is that the front hooks 34 of the shelf 30 may disengage the selected set of apertures 62 simply by lifting the front of the shelf 30. The hooks 34 remain engaged with the selected set of front apertures 62 by means of gravity until the shelf 30 is sufficiently raised such that the hooks 34 rotate, by gravity, out of the selected set of apertures.

FIG. 5 is a perspective view of a multi-position display rack 10 of another embodiment of the present invention. The first side 12 includes a first mounting face 14 having front and rear columns of spaced apertures 16, 18 formed therein. The second side 20 includes a second mounting face 22 having front and rear columns of spaced apertures 24, 26 formed therein (24 not shown). The first and second sides 12, 20 are disposed parallel such that each front column aperture 16 in the first side 12 is aligned in opposition with the corresponding front column aperture 24 on the second side 20 to define a set of front apertures and each rear column aperture 18 in the first side 12 is aligned in opposition with a corresponding rear column aperture 26 in the second side 20 to define a set of rear apertures. As shown in this embodiment, the first and second sides 12, 20 are formed as a continuous sheet element. It is within the teachings of the present invention that materials other than metal or even plastic could be utilized for forming the first and second sides 12, 20.

At least one removable shelf 30 is supportable between the first and second sides 12, 20. The shelf 30 includes a frame 32 having front hooks 34 and rear hooks 36. The front hooks 34 are connected to the frame 32 for rotative and sliding movement within an adjustment zone 38 defined by spaced first 40 and second 42 cross members. The front hooks 34 engage a selected set of front apertures 62. Support elements 44 extend through the adjustment zone 38 and contact the front hooks 34 when the front hooks 34 are rotated to engage the set of front apertures 62 such that loads are transferred from the shelf 30 to the first and second sides 12, 20. The rear hooks 36 extend from a third cross member 46 for engaging a selected set of rear apertures 60 and include a means for locking the shelf (see FIGS. 7–9) to the set of rear apertures 60. The base support 50 is configured such that this embodiment of the present invention may be used in a stationary orientation. Other configurations of the base support 50, such as casters or other suitable moving devices, may be utilized with this embodiment of the present invention.

FIG. 6 is a side elevation view of the multi-position display rack of one embodiment of the present invention shown in FIG. 5. A plurality of shelves 30 are shown in various different inclination orientations. The middle pair of shelves 30 illustrate the inclination orientation of the shelves 30 where the selected set of front apertures 62 is level with the selected set of rear apertures 60. The upper pair of shelves 30 illustrate the inclination orientation of the shelves 30 where the selected set of front apertures 62 is disposed at a level below the selected set of rear apertures 60. The bottom pair of shelves 30 illustrates the inclination orientation of the shelves 30 where the selected set of front apertures 62 is disposed at a level above the selected set of rear apertures 60. In each of the inclination orientations described above, the shelf 30 is supported between the first and second sides 12, 20. For each selected set of rear apertures 60, a plurality of selected sets of front apertures 62 may be utilized. As discussed above, the selected set of front apertures 62 may be level, below, or above the selected set of rear apertures 60. The inclination orientation for a shelf 30 is approximately in the range of 0–22° either above or below the selected set of rear apertures 60. It will be recognized by one of skill in the art that the shelves 30 described above in FIGS. 1–4 and hereafter in FIGS. 10 and 11 can be utilized as described above with respect to FIGS. 5 and 6.

Figure 7:
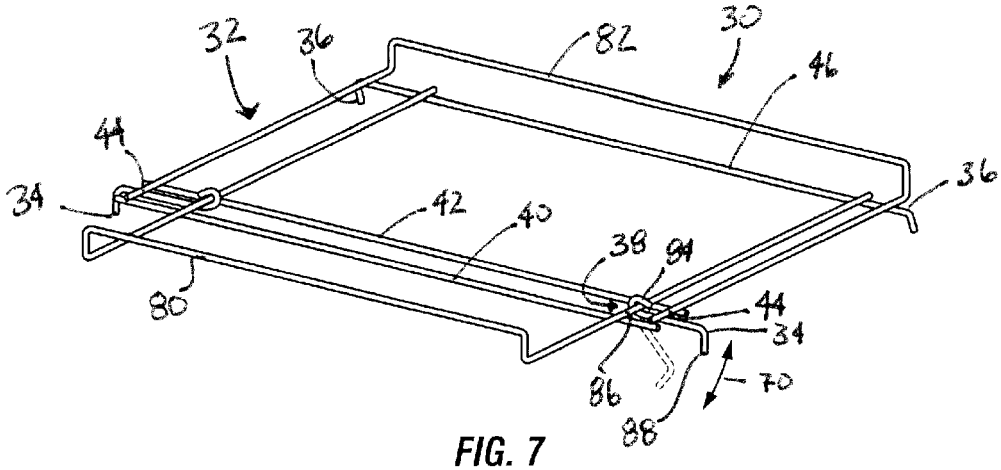
FIG. 7 is a perspective view of a removable shelf of a multi-position display rack in accordance with one embodiment of the present invention.
Figure 8:
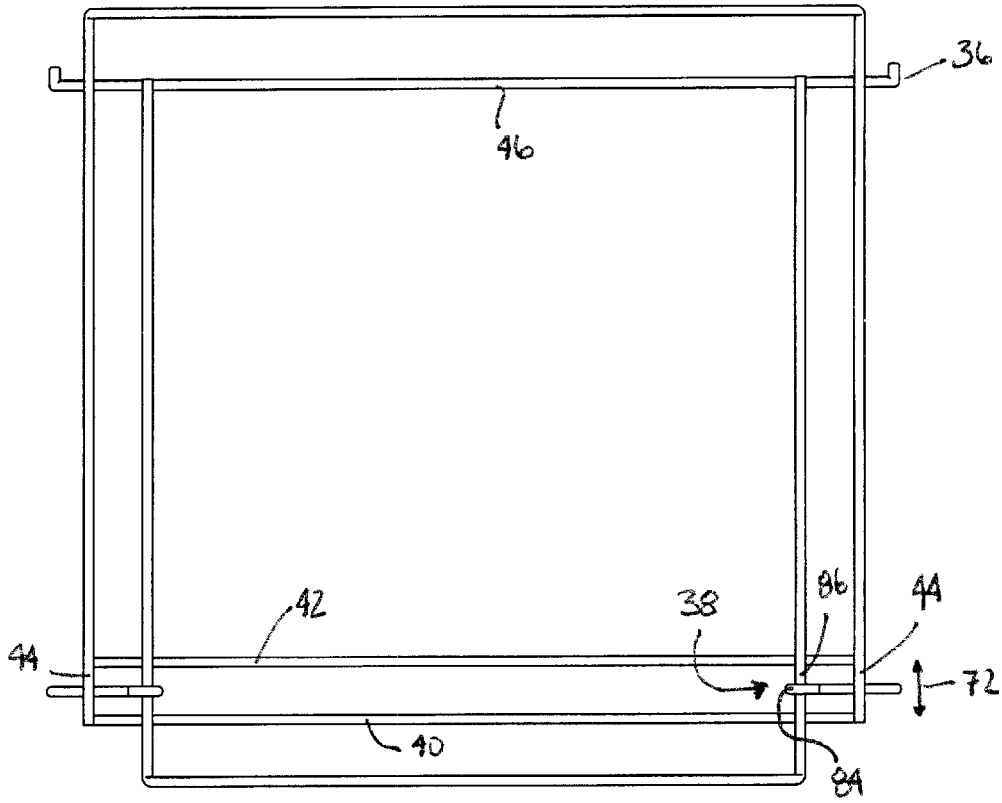
FIG. 8 is a top plan view of the removable shelf of a multi-position display rack in accordance with one embodiment of the present invention.
Figure 9:
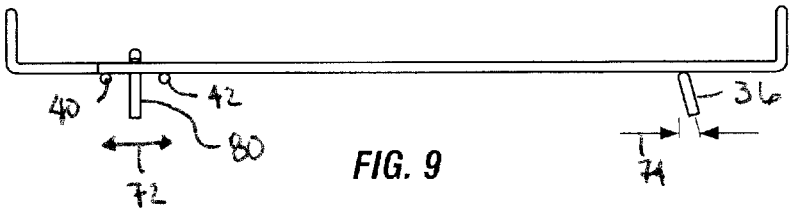
FIG. 9 is a side elevation view of a removable shelf in accordance with one embodiment of the present invention.

FIGS. 7–9 are perspective, top plan and side elevation views of the shelf 30 of one embodiment of the present invention. The shelf 30 is adapted to be supported in a multi-position display rack as described in detail above. The shelf 30 includes a wire frame 32 including front hooks 34 and second hooks 36. The front hooks 34 are connected to the wire frame 32 for rotative movement, indicated by arrow 70 and sliding movement indicated by arrow 72, see FIGS. 8 and 9. It is within the teachings of this embodiment that the front hooks 34 can be connected to the frame 32 in any suitable manner as my be known in the prior art in order to provide the rotative and sliding functions. The front hooks 34 are moveable within an adjustment zone 38 defined between spaced first cross member 40 and second cross member 42. Adjustment of the front hooks 34, front to back, within the adjustment zone permits the various different inclination orientations as described above.

Support wires 44 extend through the adjustment zone 38 for contact with the front hooks 34 when the front hooks 34 engage a selected set of front apertures so that loads are transferred from the shelf 30 to the first and second sides.

The rear hooks 36 extend from a third cross member 46 and include a means for locking the shelf to the rack. As shown in this embodiment of the present invention, the means for locking the shelf to the first and second sides includes the rear hooks 36 rotated relative to the third cross member and angled away from the front hooks 34. The preferred angle of rotation is indicated by arrows 74 and is approximately in the range of 15 degrees. The locking means secures the shelf 30 to the rack such that the front of the shelf 30, immediately adjacent the front hooks 34, must be lifted at least 15 degrees from the installed position. This is advantageous in that the shelf cannot be unintentionally dislodged by jostling as is common with prior art shelf/rack designs.

The frame 32 further includes a first stop 80 and a second stop 82 which is wider than the first stop 80. The stops 80, 82 prevent the products from sliding off the shelf 30 when the shelf 30 is installed in an inclined orientation. In this embodiment the proximate end 84 of each first hook 34 is crimped onto a keeper wire 86 of the frame 32. A distal end 88 of each first hook 34 is adapted to engage the selected set of front apertures. The support wires 44 preferably contact an intermediate section of the first hooks 34 between the proximate and distal ends 84, 88. The first and second cross members 40, 42 are preferably spaced apart approximately 1½ inches. It is within the teachings of the present embodiment that other spacing dimensions of the first and second cross members 40, 42, could be utilized for permitting other inclined orientations.

Figure 10:
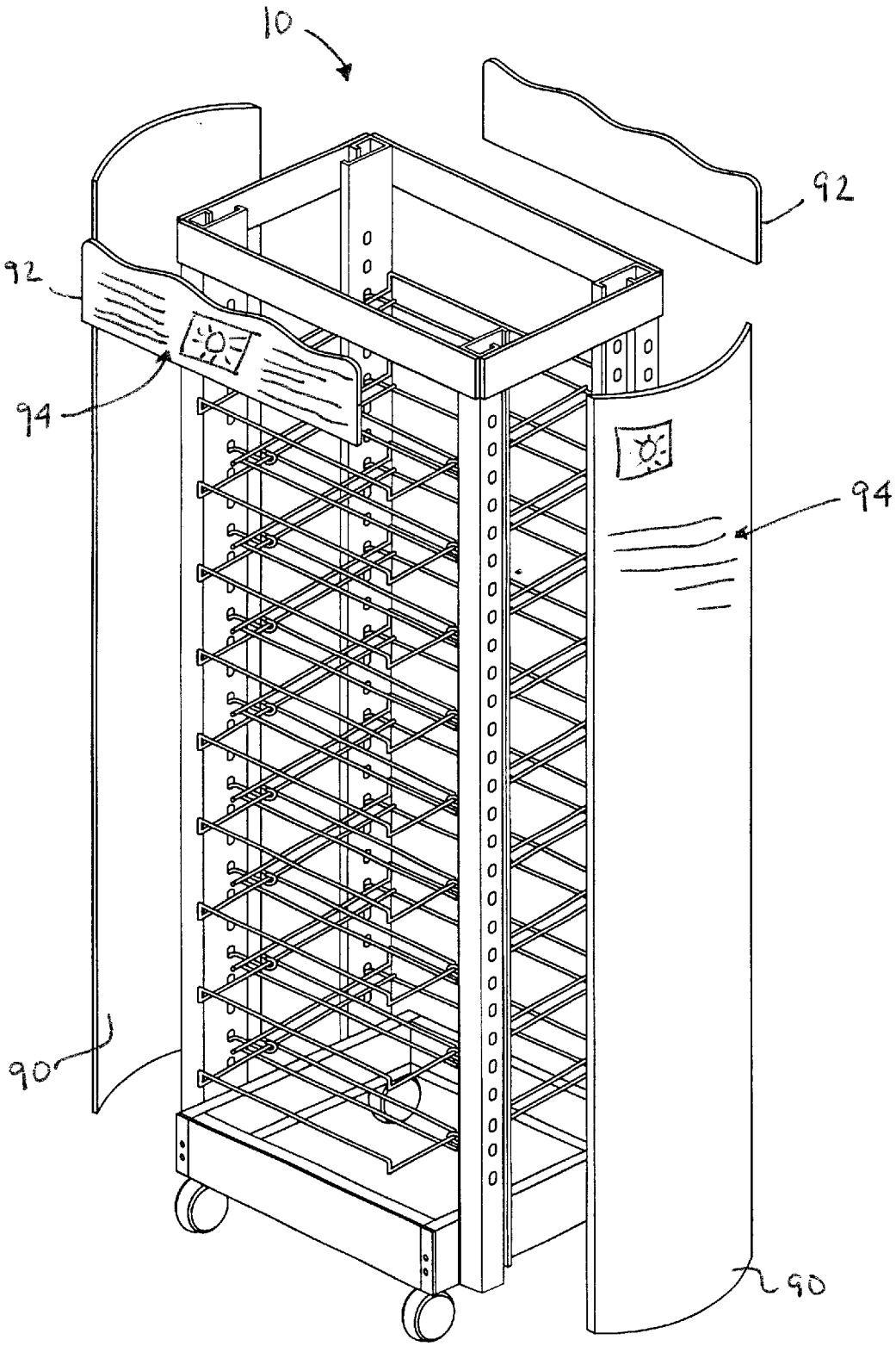
FIG. 10 is an exploded perspective view of a multi-position display rack in accordance with another embodiment of the present invention.

FIG. 10 is a perspective view of the multi-position display rack 10 of another embodiment of the present invention. The structure and construction of the display rack in this embodiment of the present invention is substantially similar to that described above with respect to FIGS. 1–4 and 7–9. In this embodiment of the present invention, at least one side panel 90 is connected to the display rack 10. A header panel 92 may also be connected to the rack 10 in this embodiment. Each of the side and header panels 90, 92 may be used to advertise the products offered for sale on the rack 10. Indicia 94 may be provided on the side and header panels 90, 92 in the form of images, text or other suitable indicia, to advertise the products for sale on the display rack 10. The side and header panels 90, 92 may be connected to the display rack 10 in any conventional manner, with or without fasteners.

Figure 11:
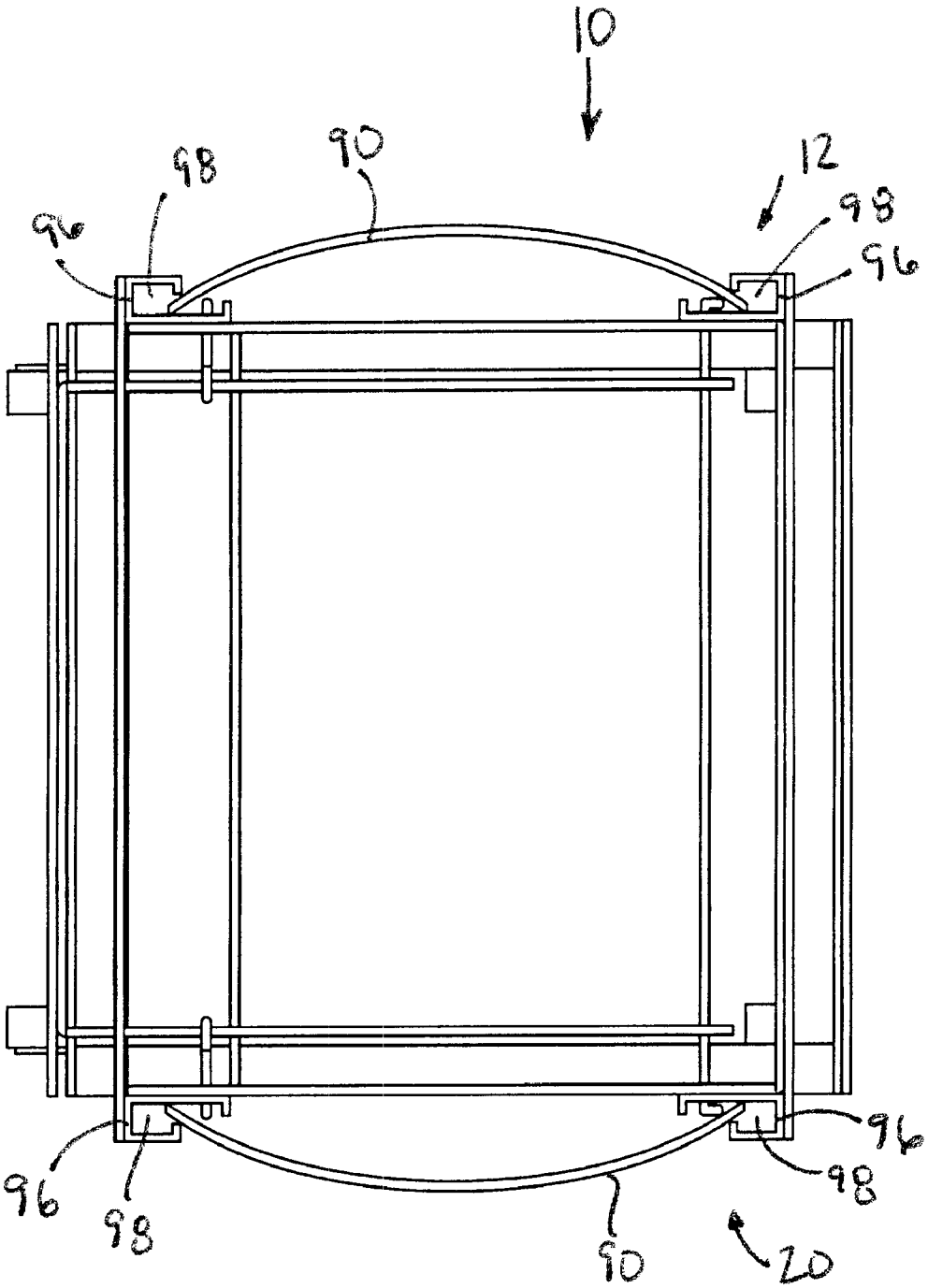
FIG. 11 is a top plan view of a multi-position display rack in accordance with another embodiment of the present invention as shown in FIG. 10.

FIG. 11 is a top plan view of the display rack 10 of another embodiment of the present invention as shown in FIG. 10. At least one shelf 30 is connected to the first and second sides 12, 20 or the display rack 10 and locked in position. Preferably, the side panels 90 are connected to the display rack disposed between outer edges 96 of the first and second sides 12, 20 in a receptacle 98 defined by the formed uprights 12*a*, 12*b*, 20*a* and 20*b*. The side panels 90 are sufficiently bowed such that they exert a force against the outer edges 96 and remain installed in position. In another embodiment, the side panels 90 may have a dimension equal to the distance between adjacent outer edges 96 such that when installed, the side panels are flat with respect to the mounting face.

Thus, as shown in the disclosed embodiments, the multi-position display racks of the present invention fulfills the need in the prior are for providing an exceptionally simple and economical display rack including shelves which can be locked in position and utilized in various different inclined orientations.

The invention is not limited to the particular details of the apparatus depicted and other modifications and applications may be contemplated. Certain other changes may be made in the above-described apparatus without departing from the true spirit and scope of the invention here involved. It is intended, therefore, that the subject matter of the above-depiction shall be interpreted as illustrated and not in a limiting sense.

What is claimed is:

1. A multi-position display rack, comprising:

a first side including a first mounting face having front and rear columns of spaced apertures formed therein;

a second side including a second mounting face having front and rear columns of spaced apertures formed therein;

the first and second sides disposed parallel such that each front column aperture in the first side is aligned in opposition with a corresponding front column aperture in the second side to define a set of front apertures and each rear column aperture in the first side is aligned in opposition with a corresponding rear column aperture in the second side to define a set of rear apertures; and at least one removable shelf supportable between the first and second sides, the shelf comprising:

a frame including front hooks and rear hooks;

the front hooks each connected to the frame for rotative and sliding movement within an adjustment zone defined by spaced first and second cross members for engaging a selected set of front apertures;

support elements extending through the adjustment zone for contacting the front hooks when the front hooks are rotated to engage the set of front apertures such that loads are transferred from the shelf to the first and second sides; and the rear hooks extending from a third cross member for engaging a selected set of rear apertures and including a means for locking the shelf to the set of rear apertures wherein the front hooks may engage a plurality of selected sets of front apertures for each selected set of rear apertures when engaged by the rear hooks.

2. The rack as recited in claim 1, wherein the first and second sides are defined by separate sheet-formed elements.

3. The rack as recited in claim 1, wherein the first and second sides are each defined by a pair of spaced upright elements.

4. The rack as recited in claim 1, wherein each of the apertures are formed as vertically elongated slots.

5. The rack as recited in claim 1, wherein the frame further includes a first stop and a second stop which is wider than the first stop.

6. The rack as recited in claim 1, wherein a proximate end of each first hook is crimped onto a keeper element of the frame.

7. The rack as recited in claim 1, wherein the support elements contact an intermediate section of the first hooks.

8. The rack as recited in claim 1, wherein a distal end of each first hook engages the selected set of front apertures.

9. The rack as recited in claim 1, wherein the first and second cross members are spaced apart approximately one and one-half inches.

10. The rack as recited in claim 1, wherein the means for locking the shelf includes the second hooks angularly rotated relative to the third cross member.

11. The rack as recited in claim 10, wherein the angle of rotation is approximately 15 degrees.

12. The rack as recited in claim 1, wherein the shelf is supported between the first and second sides in an inclined orientation.

13. The rack as recited in claim 1, wherein the selected set of front apertures is level with the selected set of rear apertures.

14. The rack as recited in claim 1, wherein the selected set of front apertures is disposed at a level below the selected set of rear apertures.

15. The rack as recited in claim 1, wherein the plurality of selected sets of front apertures provides a range of inclination for the shelf of approximately 0–22 degrees.

16. The rack as recited in claim 1, wherein the means for locking the shelf includes angling the second hooks away from the first hooks.

17. The rack as recited in claim 1, further including at least one side panel connected to the rack.

18. The rack as recited in claim 1, further including at least one header panel connected to the rack.

19. A shelf adapted to be supported in a multi-position display rack, including first and second sides, each having front and rear columns of spaced apertures, the shelf comprising:

a wire frame including first hooks and second hooks;

the first hooks each connected to the wire frame for rotative and sliding movement within an adjustment zone defined by spaced first and second cross members and adapted for engaging a selected set of front apertures;

support wires extending through the adjustment zone for contacting the first hooks when the first hooks are rotated to engage the selected set of front apertures so that loads are transferred from the shelf to the rack; and, the second hooks extending from a third cross member adapted for engaging a selected set of rear apertures and including a means for locking the shelf to the rack.

20. The shelf as recited in claim 19, wherein the wire frame further includes a first stop and a second stop, which is wider than the first stop.

21. The shelf as recited in claim 19, wherein a proximate end of each first hook is crimped onto a keeper wire of the wire frame.

22. The shelf as recited in claim 19, wherein the support wires contact an intermediate section of the first hooks.

23. The shelf as recited in claim 19, wherein a distal end of each first hook is adapted to engage the selected set of front apertures.

24. The shelf as recited in claim 19, wherein the first and second cross members are spaced apart approximately one and one-half inches.

25. The shelf as recited in claim 19, wherein the means for locking the shelf includes the second hooks angularly rotated relative to the third cross member.

26. The shelf as recited in claim 25, wherein the angle of rotation is approximately 15 degrees.

27. The shelf as recited in claim 19, wherein the means for locking the shelf includes angling the second hooks away from the first hooks.

28. The rack as recited in claim 19, further including at least one side panel connected to the rack.

29. The rack as recited in claim 19, further including at least one header panel connected to the rack.

* * * * *